US007347705B1

(12) United States Patent
Huang et al.

(10) Patent No.: US 7,347,705 B1
(45) Date of Patent: Mar. 25, 2008

(54) ADAPTER FOR A FLUORESCENT TUBE

(75) Inventors: Alex Huang, Taichung County (TW); David Tsai, Taichung County (TW)

(73) Assignee: Cvilux Corporation, Taipei County (TW)

( * ) Notice: Subject to any disclaimer, the term of this patent is extended or adjusted under 35 U.S.C. 154(b) by 10 days.

(21) Appl. No.: 11/584,372

(22) Filed: Oct. 23, 2006

(51) Int. Cl.
*H01R 33/02* (2006.01)

(52) U.S. Cl. ..... 439/231; 436/226; 436/300

(58) Field of Classification Search ..... 439/231, 439/300, 310

See application file for complete search history.

(56) References Cited

U.S. PATENT DOCUMENTS 3,462,725 A * 8/1969 Garver et al. ..... 439/231
5,245,518 A * 9/1993 Aspenwall ..... 362/640
5,261,831 A * 11/1993 Vendal et al. ..... 439/232
5,816,837 A * 10/1998 Henrici et al. ..... 439/231
5,954,535 A * 9/1999 Lawrence ..... 439/439
6,988,906 B1 * 1/2006 Chen ..... 439/226

* cited by examiner

*Primary Examiner*—Truc Nguyen
(74) *Attorney, Agent, or Firm*—Alan Kamrath; Kamrath & Associates PA

(57) ABSTRACT

An adapter for a fluorescent is adapted to apply to cold cathode fluorescent tube on LED display and has a cover with two inner grooves and a switch portion having a track, a body slidably engaged with the cover, a metallic terminal stand attached to and controlled by the switch portion. The body has two rails correspondingly engaged with the grooves of the cover and has a recess for resting the fluorescent tube. The metallic terminal stand has two resilient arms close each other to perform a Y-shaped opening at distal ends and an oval expansion hole below the Y-shaped opening. When the cover is pushed to slide along the trail on the body, the track on the body with a narrow section presses abutting faces on the resilient arms and limits the expansion of the resilient arms on the metallic terminal stand so as to quickly and detachably clamp the fluorescent tube.

7 Claims, 9 Drawing Sheets

FIG. 6A
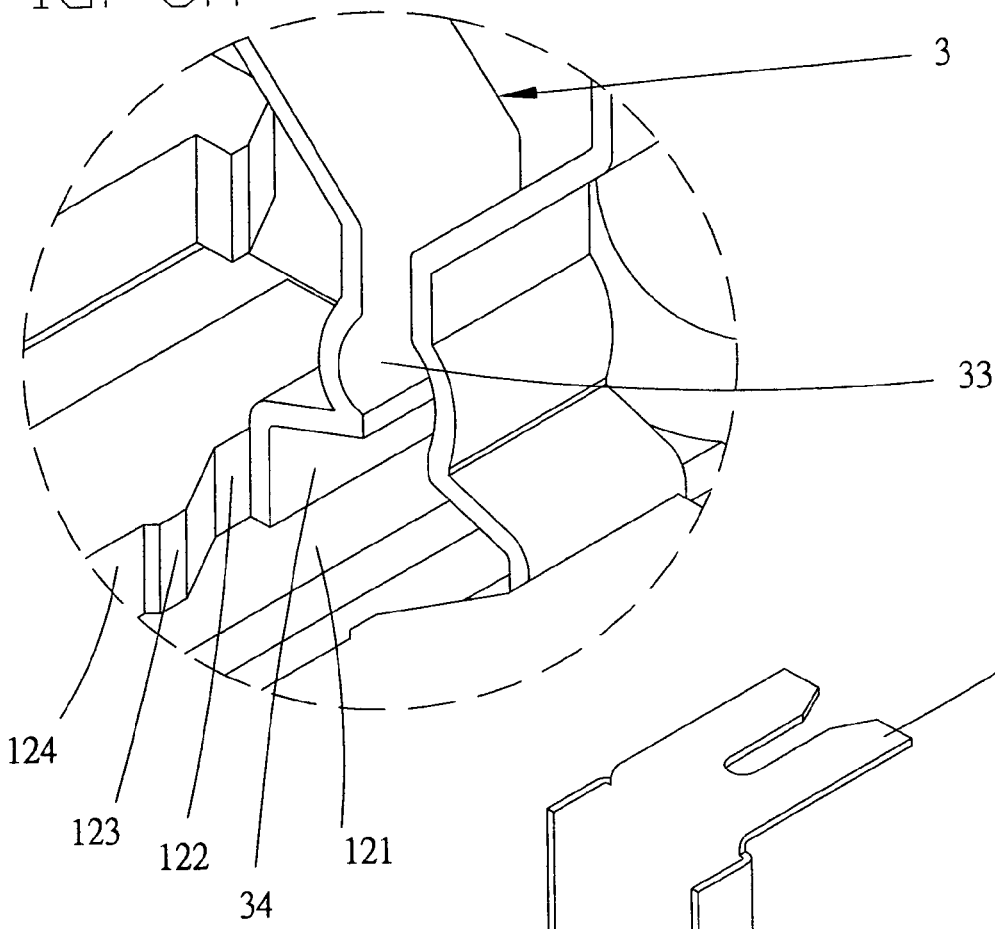
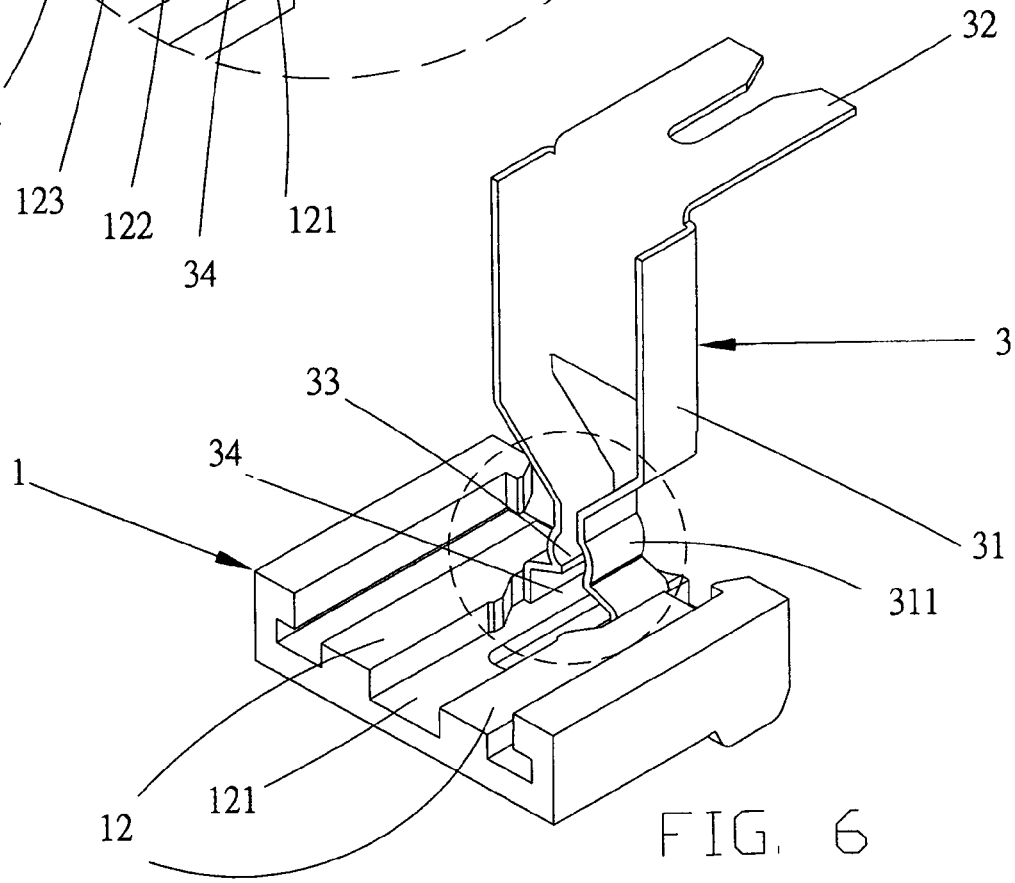
FIG. 6

B-B

ADAPTER FOR A FLUORESCENT TUBE

BACKGROUND OF THE INVENTION

1. Field of the Invention

The present invention relates to an adapter for a fluorescent tube, and more particularly to an adapter for a cold cathode fluorescent tube (CCFT) on a light emitting diode (LED) display to electrically connect to a circuit board.

2. Description of Related Art

Electronic appliances with LED must contain many fluorescent tubes to show the brightness of screens. A conventional method to assemble the fluorescent tubes with one electronic appliance is to weld by conductive welding rods to correspondingly attach to a circuit board. However, the conventional method causes some problems as follows:

1. Because the conventional welding method is achieved by handiwork to combine a conductive shaft on the fluorescent tube with the circuit board, manufacturing quality of the welding is poor and stability of the electronic appliances is unsure. Therefore, quality control of the electronic appliances is always a chock point for manufacturers.
2. Manufacturing speed in handiwork is relatively low in comparison with automatically mechanized process and thus yield is limited.
3. Without possibility of using automatically mechanized process, quantity of the electronic appliances with fluorescent tubes can not be greatly increased. Therefore, prices of the electronic appliances are kept high in the market so that progress in this field is dragged.
4. When the fluorescent tubes are malfunctioned, the replacement is troublesome because of the welding combination is undetachable in a convenient way.

According to above description, the conventional method for attaching the fluorescent tubes still has some drawbacks in manufacture.

SUMMARY OF THE INVENTION

A main objective of the present invention is to provide an adapter for a fluorescent tube that can be quickly detached and attached.

To achieve the foregoing objective, the adapter comprises:

a cover being U-shaped and having two inner sidewalls, a middle portion between the two sidewalls, two grooves respectively defined on the two inner sidewalls and a switch portion formed on the middle portion, wherein a track longitudinally is defined on the switch portion and divided into a front section and a rear section having a width smaller than one of the front section;

a body slidably attached to the cover and having two rails extending from two sides of the body to correspondingly engage the grooves on the cover, a recess with shoulders defined in a front edge on the body and adapted to accommodate the fluorescent tube; and a metallic terminal stand extending through the body to combine with the cover and having two resilient arms extending toward the cover to be operationally limited by the track when the cover sliding to adapt to hold the fluorescent tube.

By having the foregoing elements, the adapter can be quickly and detachably combine with the fluorescent tube in a conveniently way by pushing the cover forward or backward.

Further benefits and advantages of the present invention will become apparent after a careful reading of the detailed description with appropriate reference to the accompanying drawings.

BRIEF DESCRIPTION OF THE DRAWINGS

FIG. 6 is a partial perspective view of a cover with a metallic terminal stand;

FIG. 6A is an enlarged perspective view of a rear joint of the metallic terminal stand and the cover as shown in FIG. 6;

DETAILED DESCRIPTION OF THE PREFERRED EMBODIMENT

Figure 1:
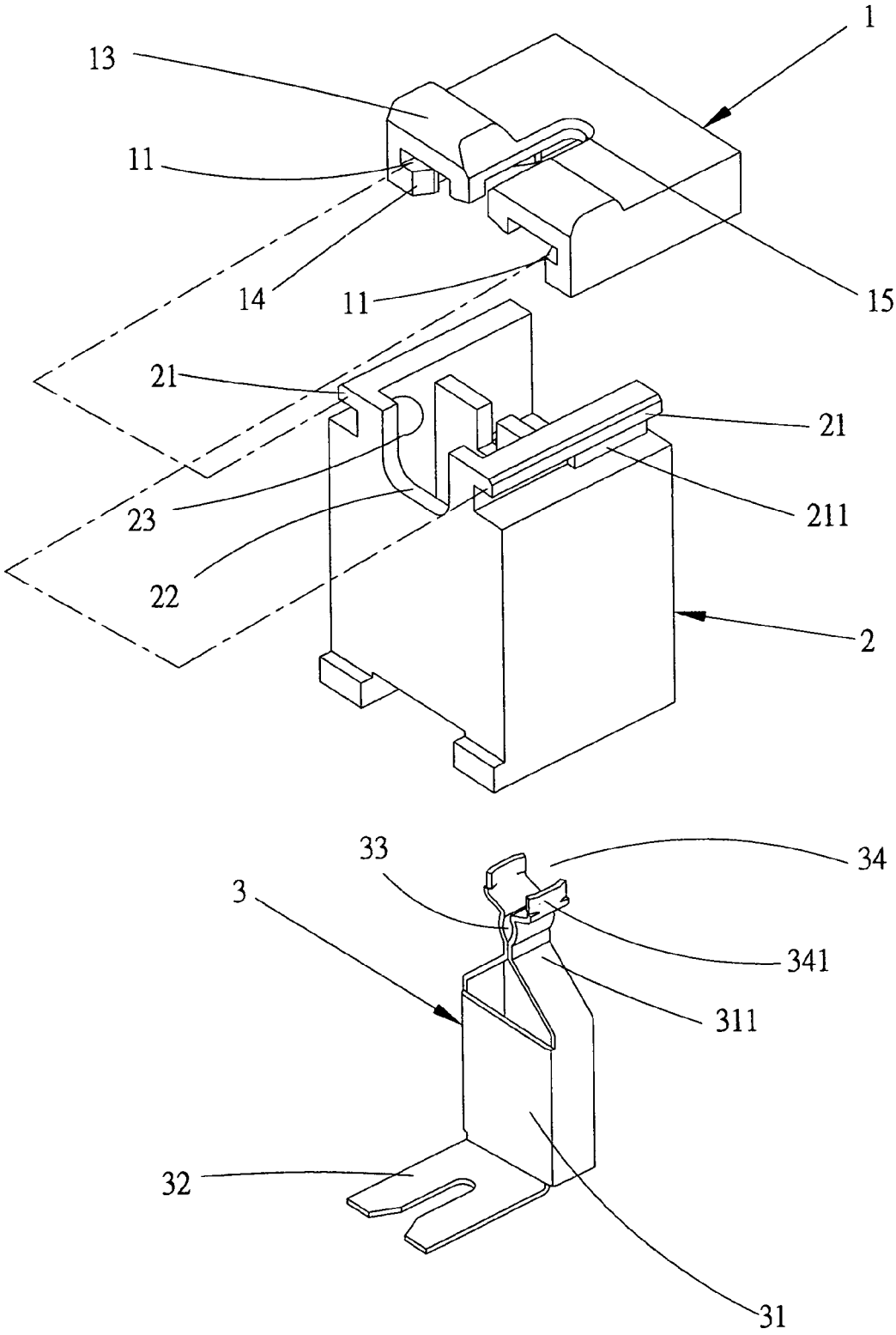
FIG. 1 is an exploded perspective view of an adapter in accordance with the present invention from a first direction.
Figure 2:
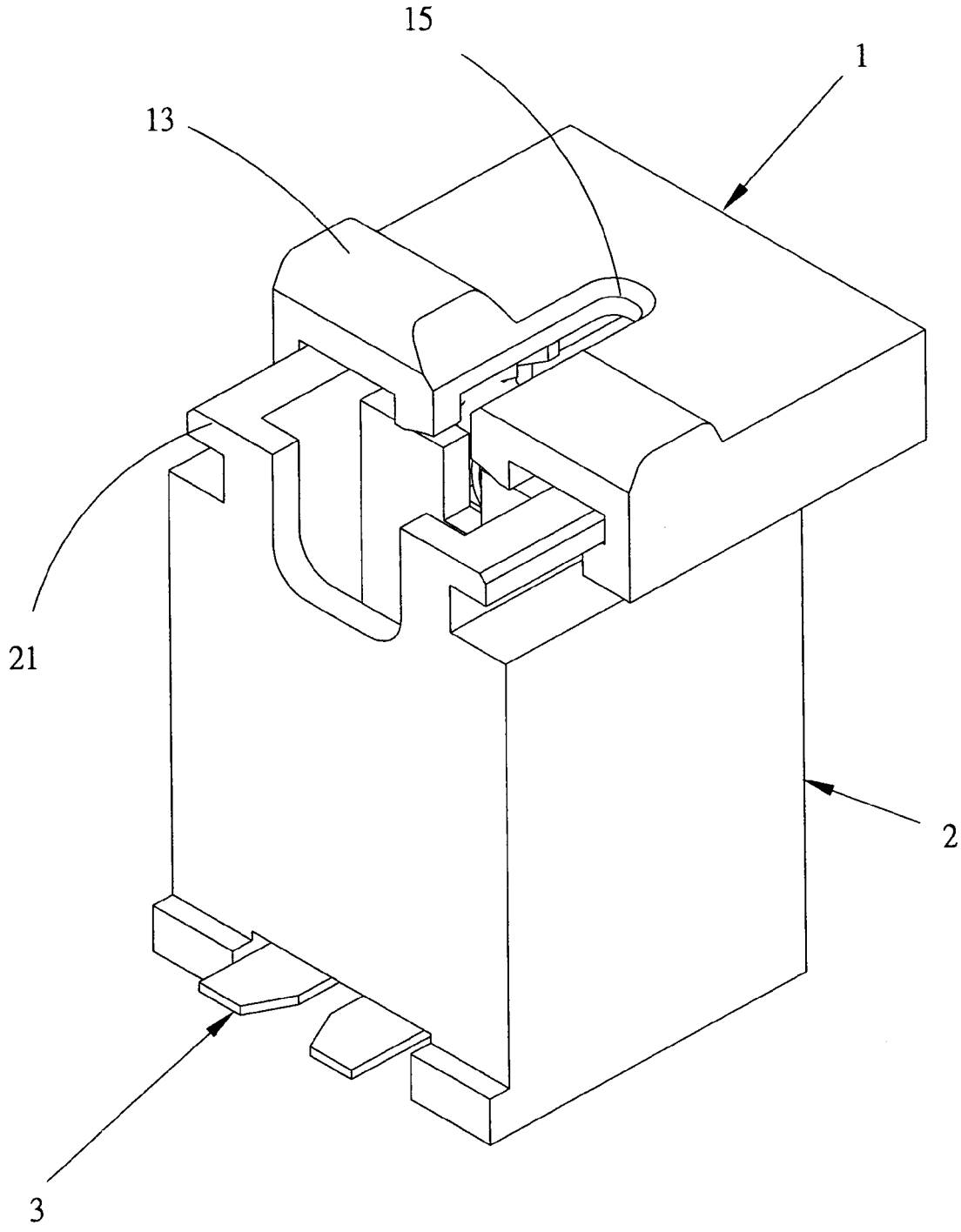
FIG. 2 is a perspective bottom view of the adapter in FIG. 1, wherein the adapter is assembled.
Figure 3:
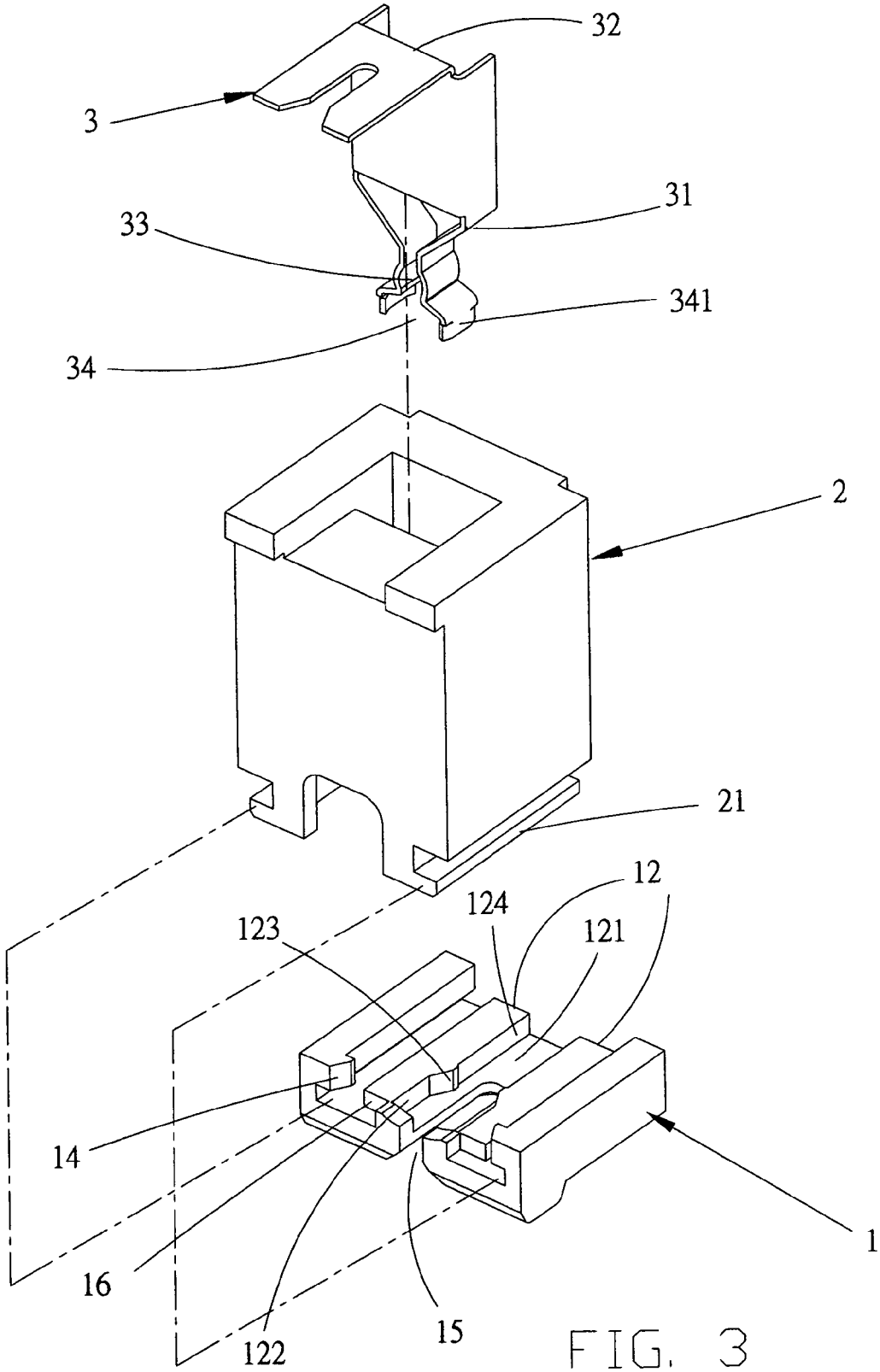
FIG. 3 is an exploded perspective view of the adapter in accordance with the present invention from a second direction.

An adapter for a fluorescent tube in accordance with the present invention is adapted to apply to cold cathode fluorescent tube on LED display and comprises a cover with two inner grooves and a switch portion having a track, a body slidably engaged with the cover, a metallic terminal stand attached to and controlled by the switch portion. The body has two rails correspondingly engaged with the grooves of the cover and has a recess for resting the fluorescent tube. The metallic terminal stand has two resilient arms close each other to perform a Y-shaped opening at distal ends and an oval expansion hole below the Y-shaped opening. When the cover is pushed to slide along the trail on the body, the track on the body with a narrow section presses abutting faces on the resilient arms and limits the expansion of the resilient arms on the metallic terminal stand so as to quickly and detachably clamp the fluorescent tube.

With reference to FIGS. 1 to 9, a preferred embodiment of the adapter for the fluorescent tube is adapted to apply to a cold cathode fluorescent tube 4 and to electrically connect to a circuit (not shown), and comprises a cover 1, a body 2 and a metallic terminal stand 3.

The cover 1 is a U-shaped shell with two sidewalls and a middle portion and includes two grooves 11 respectively defined on the two sidewalls and a switch portion 12 formed at the middle portion inside the cover 1, wherein the switch portion 12 is a bulged part with a track 121 defined therein.

The track 121 is divided into a front section 122 and a rear section 124 and has a stub 123 formed on sidewall of the track 121 between the front section 122 and the rear section 124. The width of the rear section 124 is smaller than the one of the front section 122. Moreover, the cover 1 has a pushing bar 13 formed on an outer periphery of the middle portion to facilitate the movement of the cover 1 to open or close the body 2 and a U-shaped cutout 15 defined in a front edge of the middle portion on the cover 1. Two blockers 14 are respectively formed at edges of the two grooves 11 and close to the front section 122 of the track 121 to avoid the cover 1 disengaging from the body 2. Additionally, two front stops 16 respectively protrude from sides of the switch portion 12 and extend into the grooves 11 so that the grooves 11 are substantially T-shaped to improve the stability of combination of the cover 1 and the body 2.

The body 2 is a hollow parallelepiped and has two rails 21 formed at two side faces to respectively correspondingly engage the grooves 11 of the cover 1. Each rail 21 has a stop 211 formed below to operationally abut the blocker 13 on the cover 1. A recess 22 with two shoulders 23 is defined at a front face of the body for resting the tube body 41 of the fluorescent tube 4.

The metallic terminal stand 3 perpendicularly penetrates the body 2 and has box body 31 with two resilient arms 311 extending upward. The two resilient arms 311 are drawn close to each other to perform a Y-shaped opening 34 at the distal ends and an oval expansion hole 33 below the Y-shaped opening 34. The metallic terminal stand 3 further has an extension sheet 32 laterally extending from a bottom of the box body 31 to electrically connect with the circuit or other conductive objects in operation.

When the adapter operates, the cover 1 slides on the body 2 by engaging the grooves 11 with the rails 21 on the body 2 so as to control to open or close the adapter. When the adapter is open, the cover 1 slides to misalign with the body 2 until the blockers 14 abut the stops 211 below the tracks 21 on the body 2 to limit the opening movement of the cover 1. On the contrary, when the adapter is closed, the cover 1 slides toward and align with the body 2 until the front stops 16 on the cover 1 abut the shoulder 23 on the body to limit the closing movement of the cover 1.

With particular reference to FIGS. 6, 6A, 7, 7A, 8, 8A, 9 and 9A, operations of the metallic terminal stand 3 and the switch portion 12 on the cover 11 are shown. When the adapter is open, distal ends 34 the resilient arms 331 expand and have outer abutting faces 341 to abut the front section 122 of the track 121 so that the metallic terminal stand 3 is at an open situation. When the cover 1 slides to close the adapter, the track 121 relocates to make the abutting faces 341 to be accommodated and pressed at the rear section 124 after passing the stubs 123 so that the metallic terminal stand 3 is at a closed situation.

Figure 4:
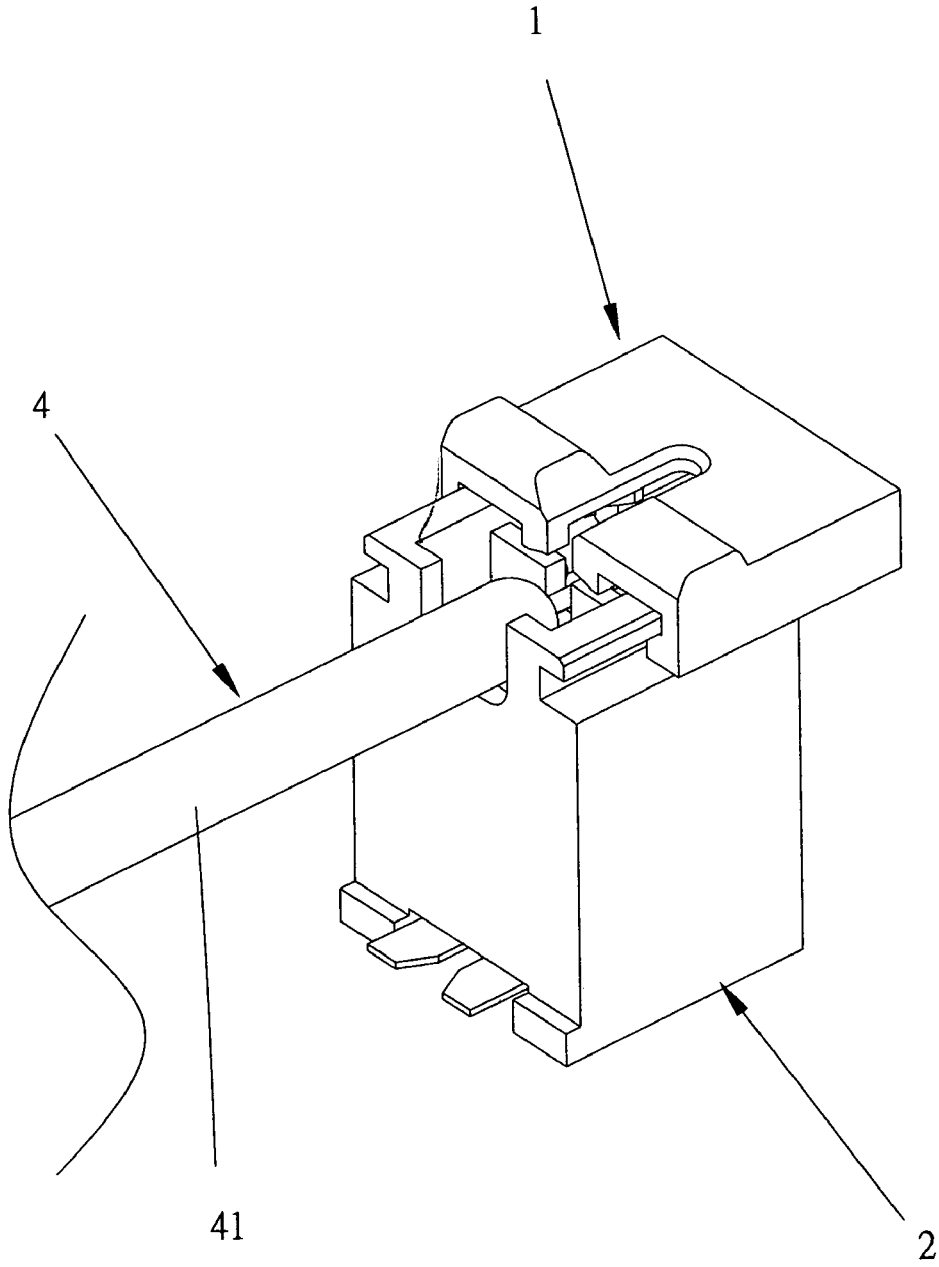
FIG. 4 is an operational perspective view of the adapter that is adapted to combine with a fluorescent tube.
Figure 5:
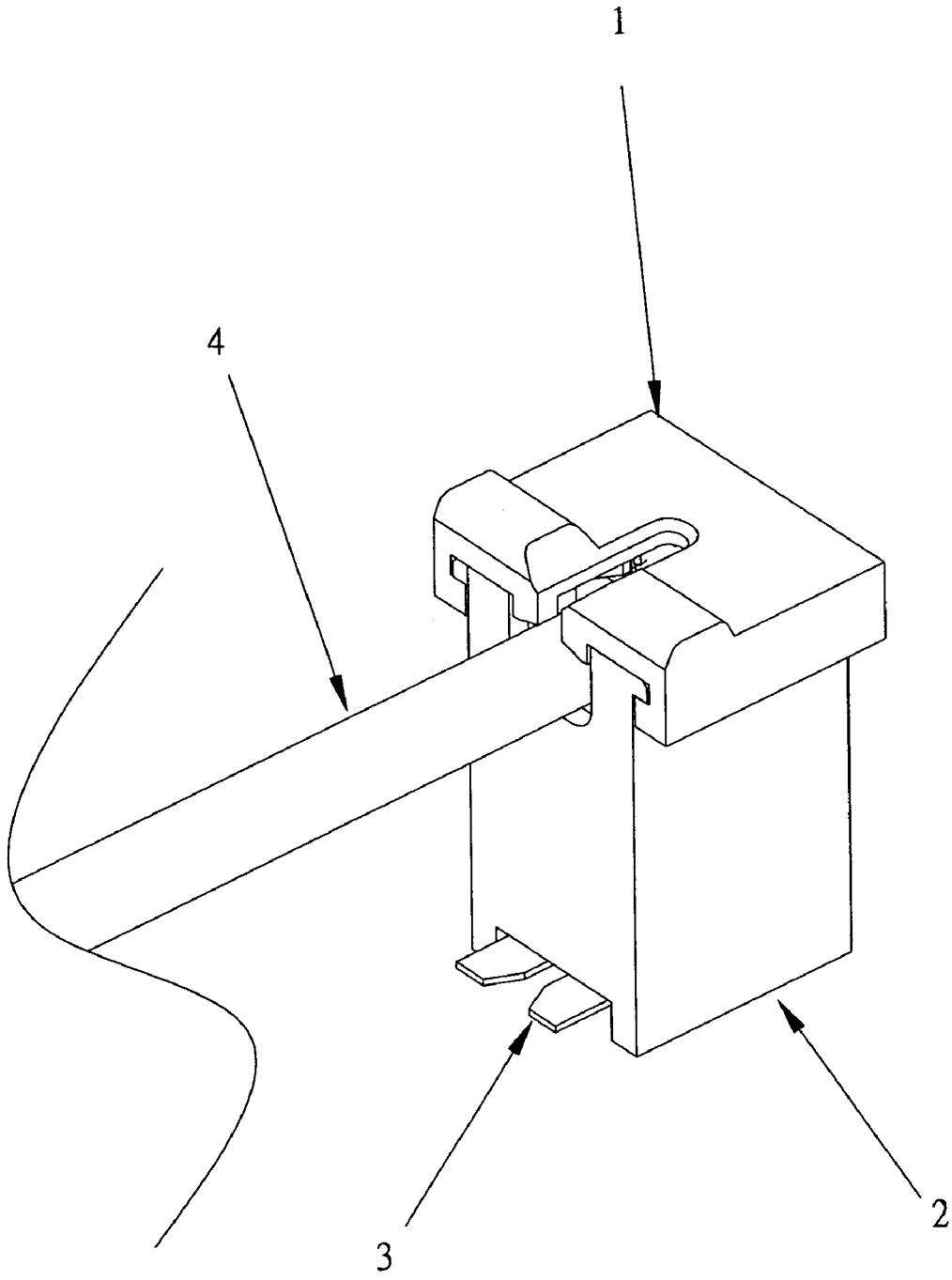
FIG. 5 is another operational perspective view of the adapter, wherein the fluorescent tube is inserted into the adapter.
Figures 7, 7A:
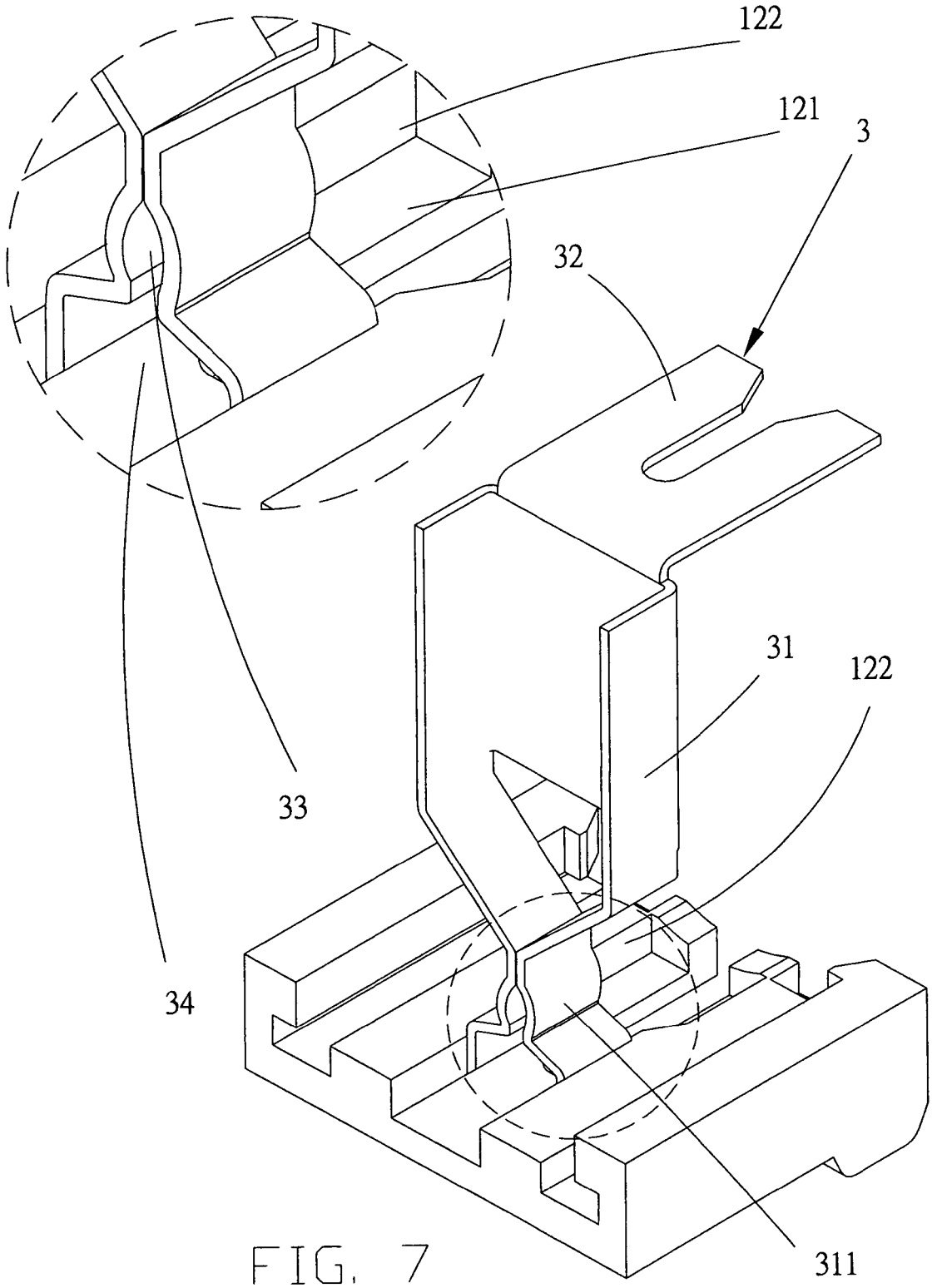
FIG. 7 is an operationally partial perspective view of the cover with the metallic terminal stand.
FIG. 7A is an enlarged perspective view of a front joint of the metallic terminal stand and the cover as shown in FIG. 7.
Figure 8A:
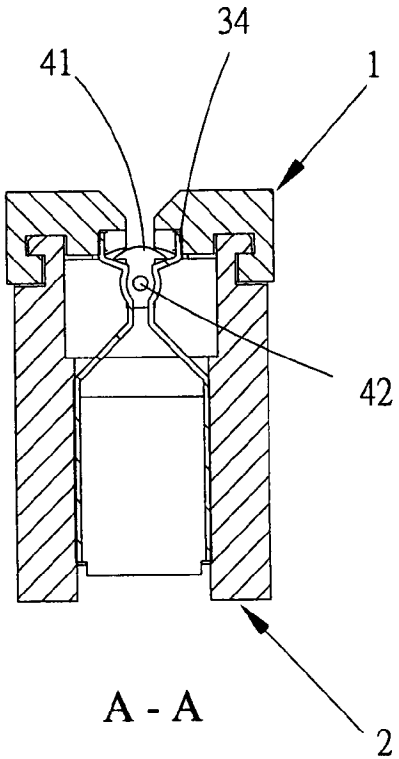
FIG. 8A is a cross-sectional view of the metallic terminal stand and the cover along line A-A as shown in FIG. 8.
Figure 8:
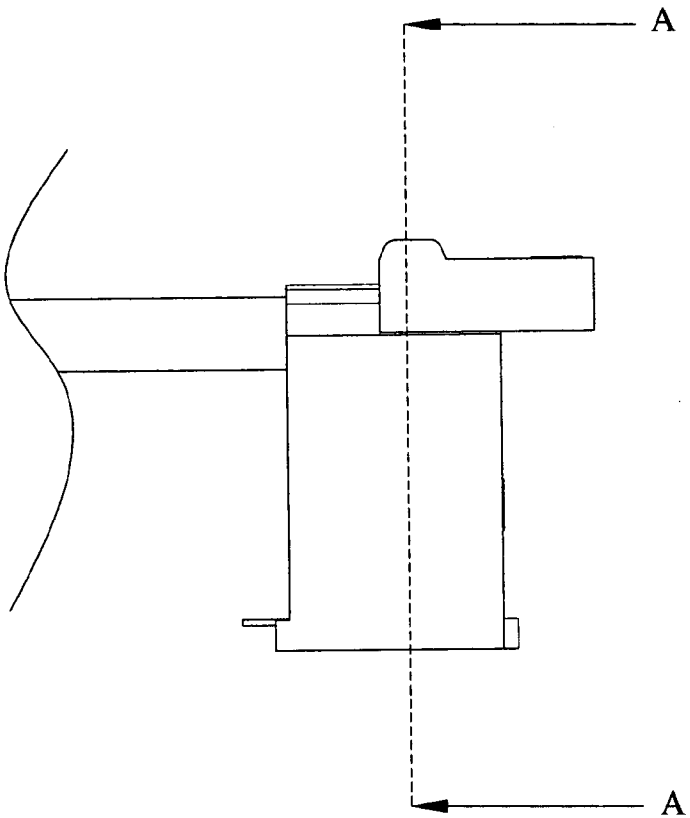
FIG. 8 is a side view of the cover with the metallic terminal stand in accordance with FIG. 6.
Figure 9A:
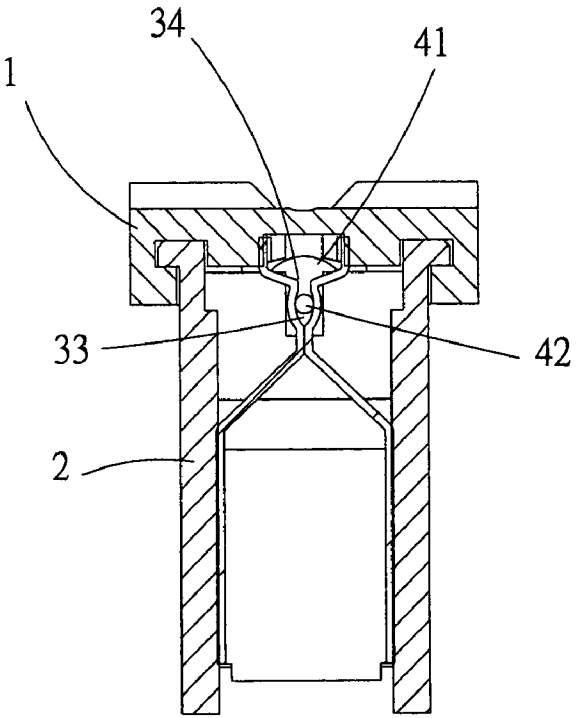
FIG. 9A is a cross-sectional view of the metallic terminal stand and the cover along line A-A as shown in FIG. 9.
Figure 9:
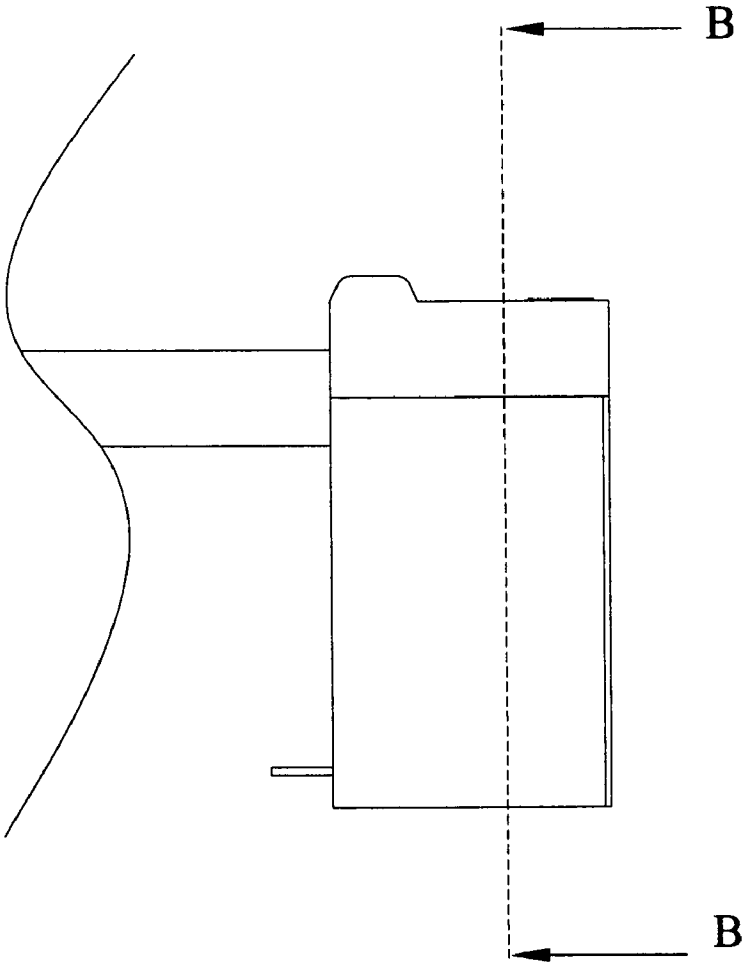
FIG. 9 is a side view of the cover with the metallic terminal stand in accordance with FIG. 7.

Attachments of the fluorescent tube are shown with further reference to FIGS. 4 and 5, the fluorescent tube 4 is located in the recess 23 and extends into the body 2 via the U-shaped cutout 15 on the cover 1. Wherein, a conductive shaft 42 on the tube body 41 of the fluorescent tube 1 rests in the Y-shaped opening 34 between the two resilient arms 331 and then slides into the oval expansion hole 33. After pushing the cover 1 to close the adapter, the abutting faces 341 slides into the rear section 124 in the track 121 to narrow the resilient arms 331 and thus to close the oval expansion opening 33 and to clamp the conductive shaft 42 firmly. Moreover, the U-shaped cutout 15 on the cover 1 also holds the corresponding end on the tube body 41 of the fluorescent tube 4 to avoid detachments.

According to above description, the adapter in the present invention can quickly and detachably combine with the fluorescent tube by simply pushing the cover 1 forward or backward. Therefore, assembly to the fluorescent tube is time-saving and convenient in use.

Although this invention has been described in its preferred form with a certain degree of particularity, it is understood that the present invention of the preferred form has been made only by way of example and that numerous changes in the details of construction and the combination and arrangement of parts any be resorted to without departing from the spirit and scope of the invention.

What is claimed is:

1. An adapter for a fluorescent tube, the adapter comprising:

a cover being U-shaped and having two inner sidewalls, a middle portion between the two sidewalls, two grooves respectively defined on the two inner sidewalls and a switch portion formed on the middle portion, wherein a track longitudinally is defined on the switch portion and divided into a front section and a rear section having a width smaller than one of the front section;

a body slidably attached to the cover and having two rails extending from two sides of the body to correspondingly engage the grooves on the cover, a recess with shoulders defined in a front edge on the body and adapted to accommodate the fluorescent tube; and a metallic terminal stand extending through the body to combine with the cover and having two resilient arms extending toward the cover to be operationally limited by the track when the cover sliding to adapt to hold the fluorescent tube.

2. The adapter as claimed in claim 1, wherein the cover further comprises two front stops respectively protruding from sides of the switch portion and operationally abutting the shoulder when the adapter is closed.

3. The adapter as claimed in claim 1, wherein the cover further comprises a U-shaped cutout defined in the middle portion of the cover and adjacent to the recess on the body; and a pushing bar formed on an outer periphery of the middle portion of the cover.

4. The adapter as claimed in claim 1, wherein the track further comprises two stubs respectively formed on sidewalls of the track between the front section and the rear section.

5. The adapter as claimed in claim 1, wherein the cover further has two blockers respectively formed at edges of the two grooves and close to the front section of the track; and each rail has a stop formed below to operationally abut one corresponding blocker on the cover.

6. The adapter as claimed in claim 1, wherein the two resilient arms are close to each other to perform a Y-shaped opening at distal ends.

7. The adapter as claimed in claim 6, wherein the two resilient arms further have an expansion hole therebetween under the Y-shaped opening.

* * * * *